US006640728B1

(12) United States Patent
Neugebauer

(10) Patent No.: US 6,640,728 B1
(45) Date of Patent: Nov. 4, 2003

(54) PASSENGER RAIL CAR SLIDING DOOR WITH HIGH PLATFORM THRESHOLD

(75) Inventor: Robert J. Neugebauer, Spring Grove, PA (US)

(73) Assignee: AAI Corporation, Hunt Valley, MD (US)

( * ) Notice: Subject to any disclaimer, the term of this patent is extended or adjusted under 35 U.S.C. 154(b) by 0 days.

(21) Appl. No.: 09/613,254

(22) Filed: Jul. 10, 2000

Related U.S. Application Data

(60) Provisional application No. 60/142,807, filed on Jul. 8, 1999.

(51) Int. Cl.[7] ..... B61D 17/00
(52) U.S. Cl. ..... 105/343; 105/343
(58) Field of Search ..... 105/332, 340, 105/341, 430, 437, 343, 329.1, 436, 427, 449; 280/166; 296/155

(56) References Cited

U.S. PATENT DOCUMENTS 961,024 A 6/1910 Saunders
2,082,536 A 6/1937 Burrows et al.
3,795,205 A * 3/1974 Gritchen et al. ..... 105/450
3,799,288 A * 3/1974 Manuel ..... 182/91
3,830,332 A 8/1974 Fontaine
3,924,545 A * 12/1975 Anders et al. ..... 105/450
4,002,891 A 1/1977 Porter
4,018,239 A 4/1977 Caldwell et al.
4,424,751 A * 1/1984 Blochlinger ..... 105/447
4,530,185 A 7/1985 Moriya et al.
4,720,116 A * 1/1988 Williams et al. ..... 182/127
5,070,794 A * 12/1991 Kunst et al. ..... 105/436
5,876,086 A 3/1999 Lagrou et al.
6,178,364 B1 * 1/2001 Delurey et al. ..... 701/36
6,179,312 B1 1/2001 Paschke et al.
6,263,804 B1 * 7/2001 Rizk ..... 105/343

* cited by examiner

*Primary Examiner*—S. Joseph Morano
*Assistant Examiner*—Franz F. Jules
(74) *Attorney, Agent, or Firm*—Banner & Witcoff, Ltd.

(57) ABSTRACT

An improved door assembly having a single movable door and a separate movable high platform threshold. The door assembly is formed of an upper door section and a lower door section fixed to the upper door section. A support member can be slidably engaged with the door assembly. A solenoid may also be disposed in the door assembly.

3 Claims, 5 Drawing Sheets

PASSENGER RAIL CAR SLIDING DOOR WITH HIGH PLATFORM THRESHOLD

CROSS-REFERENCE TO RELATED APPLICATIONS

This application claims the benefit of U.S. Provisional Application Serial No. 60/142,807 (filed Jul. 8, 1999).

FIELD OF THE INVENTION

The present invention is directed generally to systems and methods for door assemblies for railway cars, and, more particularly, to systems and methods for providing door assemblies for passenger rail vehicles having a door and a platform cooperatively arranged to operate with both high and low platforms.

DESCRIPTION OF THE RELATED ART

For many years, the rail industry has been attempting to develop a reliable, safe, and cost effective passenger ingress and egress facility for use on rail passenger vehicles for use with platforms of different levels.

Various attempts have been made to solve this problem with little success. For example, U.S. Pat. Nos. 2,056,255; 2,220,035; and 2,415,341 each show examples of designs where the steps retract into the body of the train at high platforms and extend from the body of the train at low platforms. The steps are retractable and stow away in a compartment located under the train. A trap door, or stairwell platform, is closed at high platforms when the steps are in the stowed position. At low platforms, the operator moves a manual lever to position the steps in an extended position and the stairwell platform is manually latched in an upper position. At high platforms, the steps are stowed via a manual actuating arm into a retracted position. The stairwell platform is manually closed into a lower position.

However, these designs are problematic in that the moveable steps are expensive, the extended position of the steps are not as stable and provide a undesirable feeling of instability, and the stowed position takes up substantial room in the undercarriage of the rail vehicle.

Another example is shown, for example, in U.S. Pat. No. 5,070,794, the entire disclosure of which is incorporated herein by reference for all purposes, which describes a sectioned door assembly. A sectioned door assembly employing a rail car door is divided into an upper sliding door and a lower sliding door, separate from the upper sliding door. The lower sliding door includes an integral mechanically operated latch and a high platform threshold. A stairwell platform is utilized to actuate the mechanically operated latch when the stairwell platform is slammed closed onto the high platform threshold. When impacted by the stairwell platform, the latch functions to automatically unlatch the upper door from the lower door, latch the lower door in place, and latch the stairwell platform onto the lower door. The high platform threshold supports the stairwell platform. The upper door assembly is typically supported at the top by a sliding connection to the door overhead structure. The top of the lower door panel is slidingly connected to the bottom of the upper door panel. The lower door panel is also connected via a slide assembly to the rail car body in the region of the high platform threshold. In addition, the bottom of the lower door panel is guided in a lower threshold.

This arrangement is disadvantageous for a number of reasons including: 1) it uses an excessive number of sliding elements which are susceptible to binding when the rail car racks and twists, 2) the lower door panel is not firmly restrained by its slide connection to the rail car structure and, therefore, tends to snag and become misaligned as it slides, and 3) it requires approximately six adjustment locations which must be set and maintained properly in order for the door to function properly, and 4) the two piece sliding door provides an additional ledge where accumulated ice and snow can cause the door to malfunction.

U.S. Pat. No. 3,724,396 shows another example of a sectioned door assembly having a stairwell platform with an interlocking latch assembly covering a fixed stair well. In this embodiment, the lower door section retracts under the rail vehicle car body while two upper doors slide to each side. As is conventional, the stairwell platform is latched into place in both the retracted and extended position. This arrangement is problematic from a reliability standpoint in that three doors sliding in different directions must match in the closed position. This arrangement is also complicated and expensive to manufacture.

U.S. Pat. No. 3,795,205, provides another example of a sectioned door assembly where the stairwell is made to both retract and form a portion of the outer door. This arrangement is expensive, complicated, and suffers from the same reliability problems discussed above.

U.S. Pat. Nos. 847,501; 995,889; 1,198,357; 1,425,149; 3,913,497; 3,924,545; 3,957,284; and 4,020,920, are all attempts to solve the same problem of providing a reliable passenger door and stair arrangement for high and low platforms. Each of these patents suffer from the same defects discussed above with regard to the other patents. Thus, an improved door design is required. Accordingly, the present invention seeks to take an altogether new approach to creating a reliable door assembly for allowing passenger ingress and egress at both high and low platforms that is reliable, cost effective, and requires relatively little maintenance or adjustment.

SUMMARY OF THE INVENTION

Features of one or more aspects of the invention are to increase the reliability of door assemblies in passenger rail cars for use with both high and low platforms.

One or more aspects of the present invention may solve one or more of the above problems and/or provide improved techniques for implementing passenger car door assemblies.

In one aspect of the invention, sectioned door assemblies in existing cars may be retrofitted by fixing the upper door assembly to the lower door assembly in a fixed relationship, thus substantially increasing the overall reliability of the overall door assembly. Where a sectioned door assembly having an integral latch is utilized in one embodiment, another aspect of the invention is to replace the latch such that it no longer is integral with the door.

These and other features of the invention will be apparent upon consideration of the following detailed description of preferred embodiments. For example, using designs in accordance with aspects of the present invention, it is possible to construct a passenger car rail door that is free from binding when the rail car racks and twists. Further, in some embodiments, only a single point of adjustment is required. Although the invention has been defined using the appended claims, these claims are exemplary in that one or more aspects of the invention are intended to include the elements and steps described herein in any combination or subcombination. For example, it is intended that each of the above aspects of the invention may be used individually and/or in combination with one or more other aspects of the invention defined above and/or in connection with the detailed description below. Accordingly, there are any number of alternative combinations for defining the invention, which incorporate one or more elements from the specification, including the description, claims, aspects of the invention, and/or drawings, in various combinations or subcombinations. Accordingly, it will be apparent to those skilled in the art of rail car design, in light of the present specification, that alternate combinations and subcombinations of one or more aspects of the present invention, either alone or in combination with one or more elements and/or steps defined herein, may constitute alternate aspects of the invention. Implementation of the invention in various alternate designs is within the skill in the art and intended to be covered by the appended claims. It is intended that the written description of the invention contained herein cover all such modifications and alterations.

BRIEF DESCRIPTION OF THE DRAWINGS

The foregoing summary of the invention, as well as the following detailed description of preferred embodiments, is better understood when read in conjunction with the accompanying drawings, which are included by the way of example, and not by way of limitation with regard to the claimed invention.

DETAILED DESCRIPTION OF PREFERRED EMBODIMENTS

Figure 1:
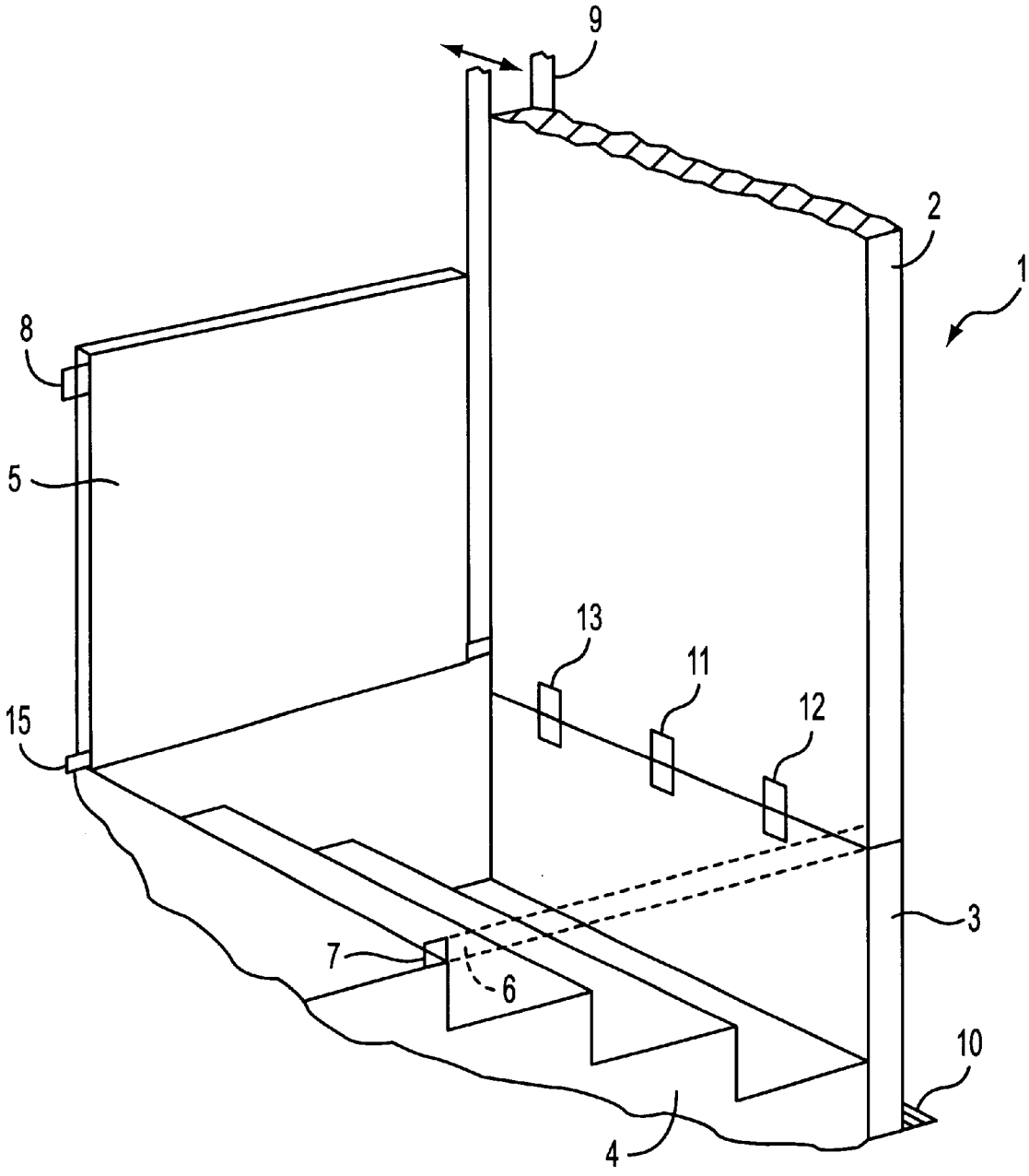
FIG. 1 is a partial diagram of one exemplary embodiment of an improved rail car door design.

Referring to FIG. 1, a door assembly 1 is shown for inclusion in a rail passenger car for use with both high and low platform ingress and egress. In the first exemplary embodiment, an upper door section 2 is coupled to a lower door section 3. In preferred embodiments, a sectioned door assembly may be made substantially more reliable by coupling the upper door section to the lower door section. It has been found that this coupling allows the door assembly to be manufactured with only a single point of adjustment in a top sliding mechanism (not shown). Further, reliability is substantially improved allowing for sectioned door assemblies to be refitted with a single assembly. In the first exemplary embodiment shown in FIG. 1, a stairwell platform 5 may be fixed in a upper position via latch 8 and in a lower position via latch 7. When stairwell platform 5 is fixed in its upper position, door assembly 1 can be slid into door pocket 9, and passengers can exit the car via stairs 4 at a low level not requiring a platform. Lower threshold 10 is provided on the exterior of the car for use in exiting the car when using stairs 4. Stairwell platform 5 may further be supported by a hinge 15 at a lower end thereof, and its free upper end may be supported by one or more support members 6 (e.g. angle iron, bracket, stop, ledge, or other support member) at the opposite wall when it is in its lower position. Thus, when stairwell platform 5 is in its lower position, it is supported by support member 6, and door assembly 1 can be slid into door pocket 9, allowing passengers to exit the car at a higher level suitable for use with elevated platforms.

Figure 2:
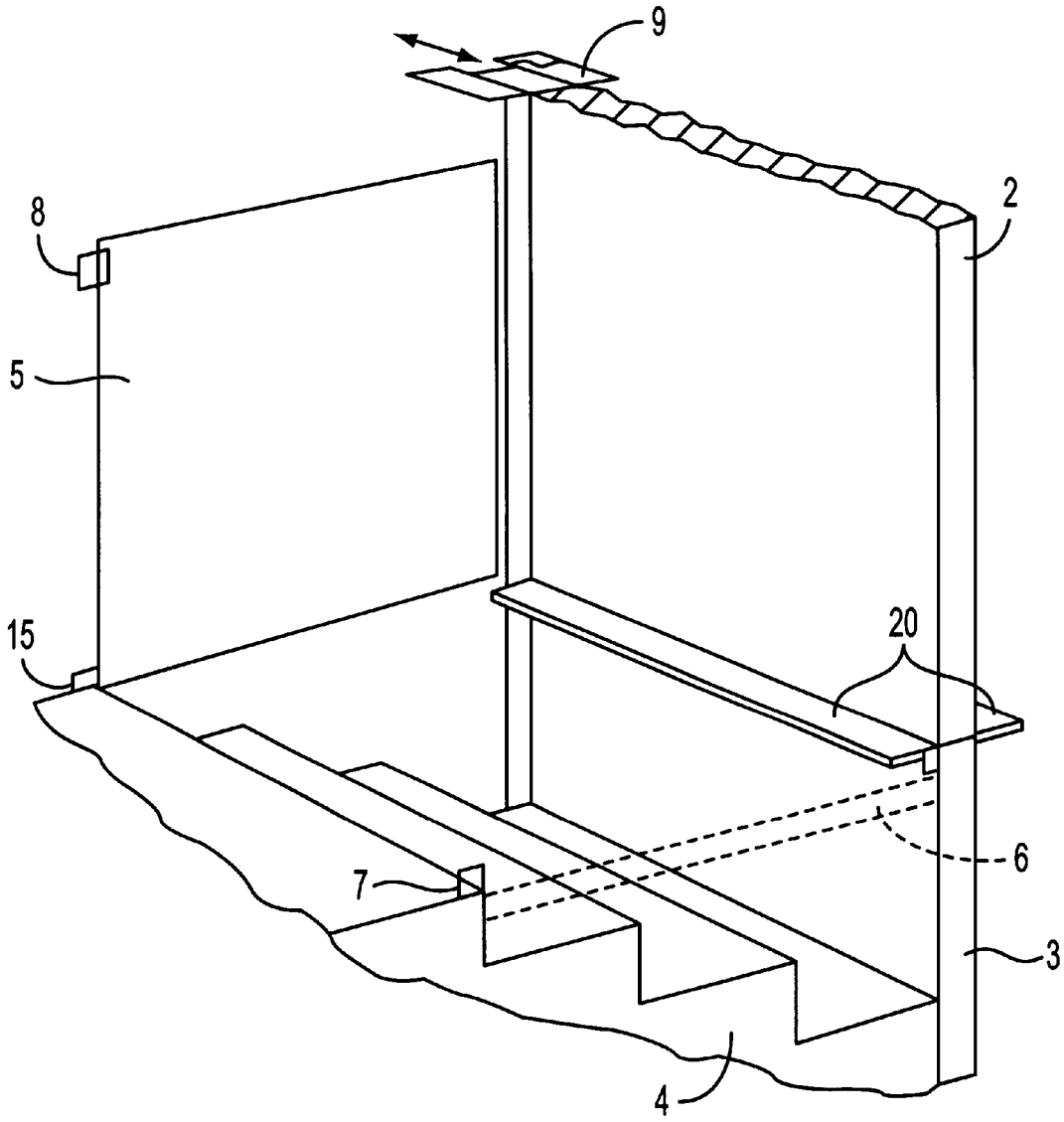
FIG. 2 is a partial diagram in accordance with a second exemplary embodiment of an improved rail car door design.

In alternate embodiments, a ledge or upper threshold 20 may be slidably or fixedly coupled to either upper door section 2 or lower door section 3, such as shown in FIG. 2. Upper threshold 20 may be alternatively configured to support stairwell platform 5. In one embodiment, the threshold 20 may be a piece of angle iron, metal, plastic, rubber, polymeric fiberglass, or a combination of any of the foregoing. Where threshold 20 is fixed to door assembly 1, it preferably slides relative to the stairwell platform 5. Where the threshold is movable relative to door assembly 1, it may slide independent of both the upper and lower sections 2, 3, or it may be coupled to the lower door section 3.

Again referring to FIGS. 1 and 2, the first and second exemplary embodiments may be configured such that upper door section 2 may be coupled to lower door section 3 using any suitable connectors 12, 13. In this manner, upper door section 2 may be physically connected to lower door section 3, substantially increasing the reliability of door assembly 1.

In alternative less preferred embodiments, upper door section 2 and lower door section 3 may be coupled through a solenoid 11. In these embodiments, solenoid 11 may be actuated via a plurality of interlocks with the stairwell platform 5, such that lower door section 3 can only be opened when stairwell platform 5 is locked in its upper position via latch 8 and the entire door assembly 1 is opened. In this embodiment, when stairwell platform 5 is locked in the lower position via latch 7, lower door section 3 may be uncoupled from upper door section 2 so that upper door section 2 may be slid into door pocket 9, allowing passengers to travel across stairwell platform 5 at a high exit level. The solenoid may be located inside or outside of the door. In many embodiments, a more reliable connection is formed by having the solenoid located within the door and locking either upper door 2 to lower door 3 or upper door 2 to threshold 20.

Figure 3:
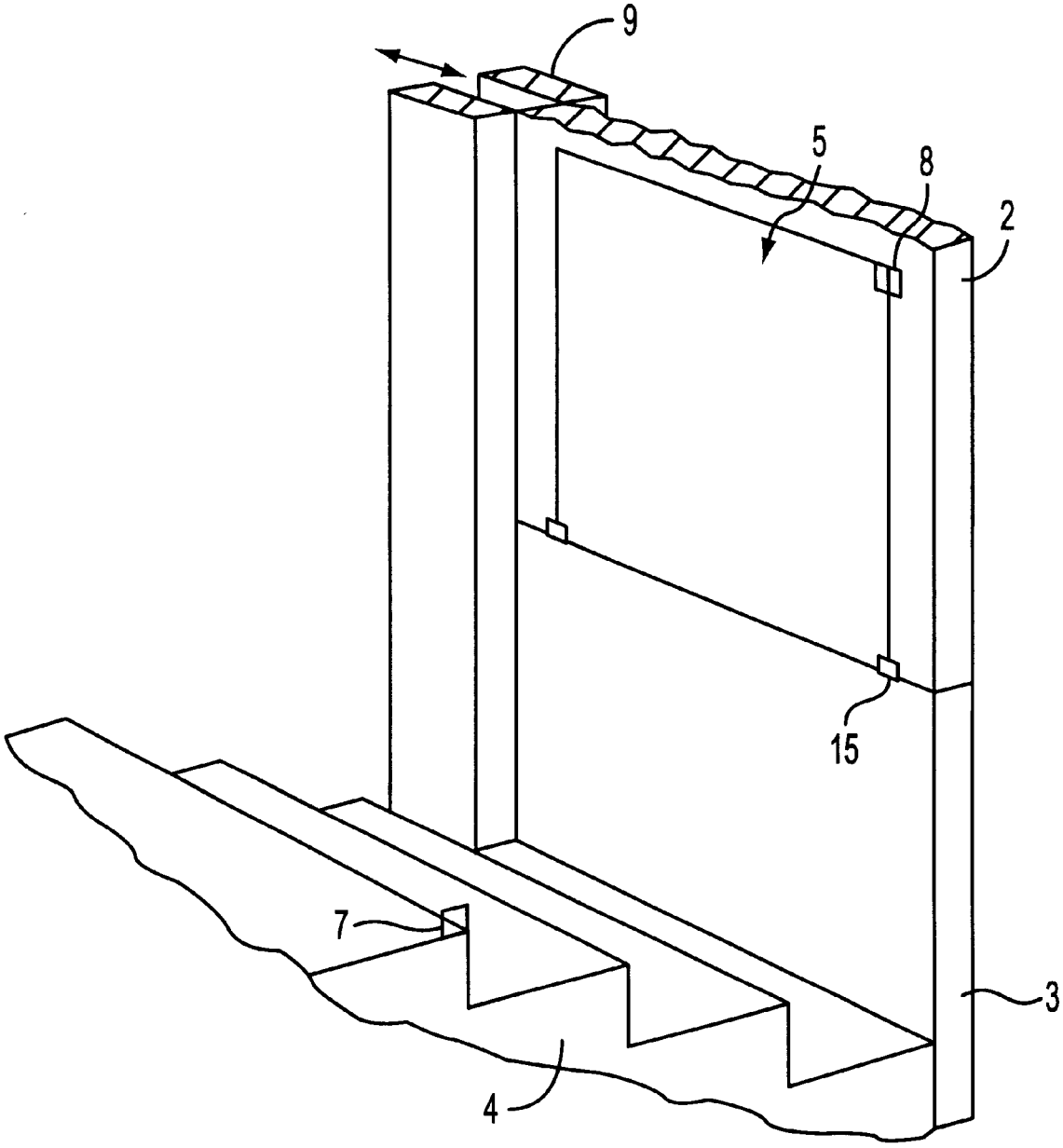
FIG. 3 is a partial pictorial view of a third exemplary embodiment of an improved rail car design.

FIG. 3 shows a third exemplary embodiment of aspects of the invention where stairwell platform 5 is located within and formed as part of the passenger rail car door assembly 1. Unlatching of stairwell platform 5 from latch 8 automatically unlocks upper door section 2 from lower door section 3. Lower door section 3 may then act as the support for the hinged end of stairwell platform 5, and stairs 4 provide support for the free upper end of stairwell platform 5 when in its lower position.

Figure 4:
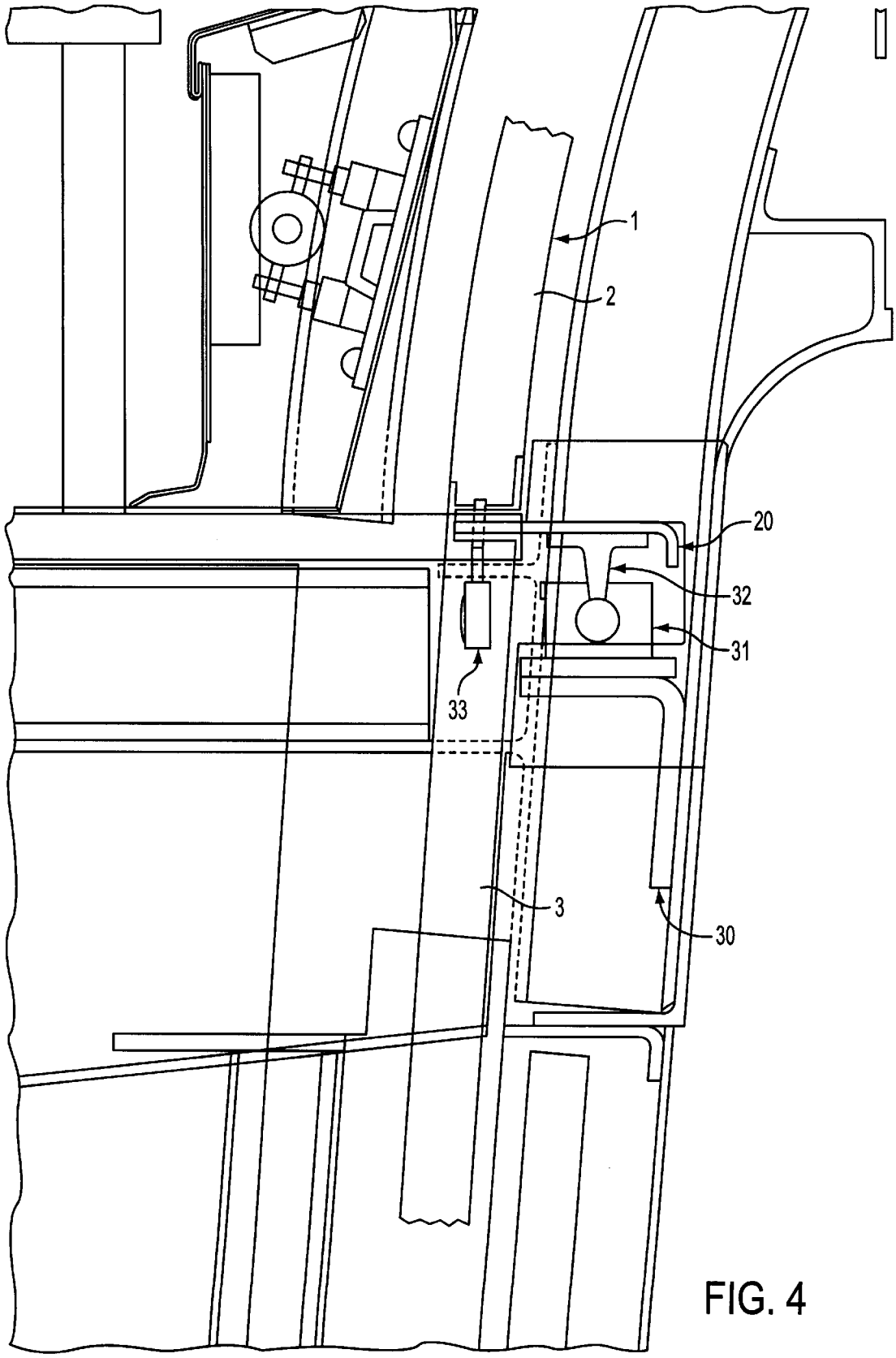
FIGS. 4–5 are partial pictorial views of a fourth embodiment of an improved rail car door design.

FIG. 4 shows yet another embodiment of the invention where the threshold 20 moves relative to the door. In this embodiment, the upper door may be fixed or movable with respect to the lower door. In many applications where reliability is a concern, it is preferable to fix the upper door relative to the lower door.

Figure 5:
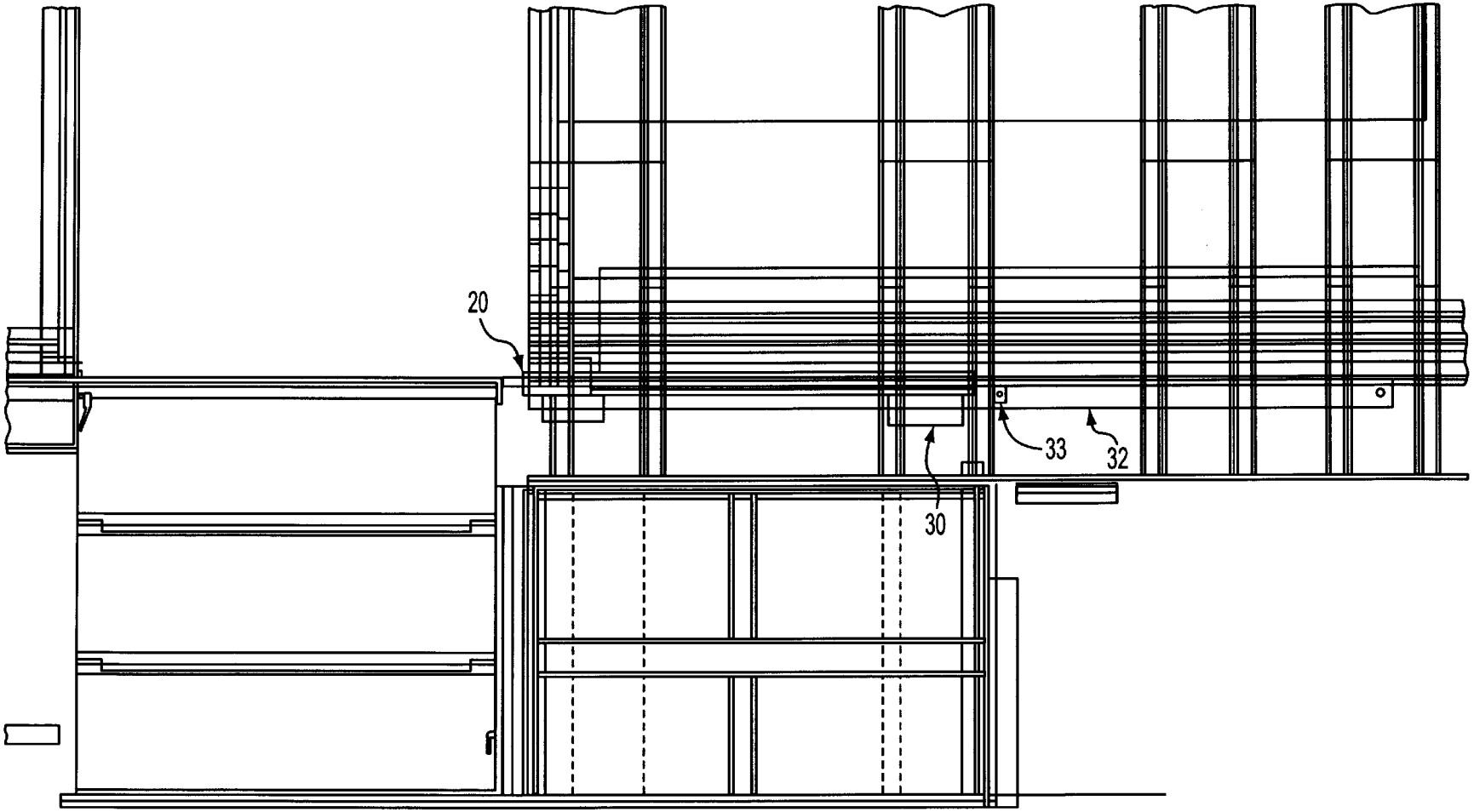

The door system shown in FIGS. 4 and 5 are specifically designed to be an improvement to the New Jersey Transit Comet II railcars. In this embodiment, the upper door section 2 may be fixed to the lower door section 3 to act as a single unit. A high platform threshold 20 may be slidingly connected to door assembly 1. The sliding threshold solves the problem of preventing injury to passengers as they enter and leave the train, while avoiding the reliability problems of a two piece door assembly. In this embodiment, upper door section 2 may be connected to the car overhead structure via slide assemblies. The integral door assembly 1 may be restrained from swinging by a roller connection at the high platform threshold, the low platform threshold, or any other suitable mechanism. A roller at the high platform threshold located, for example, in the door pocket 9 has the advantage of providing a highly reliable door assembly. The roller may be formed of any suitable polymeric material or a rubber material.

In many embodiments, it may be preferred to leave the bottom of the door assembly 1 unattached at the lower threshold. For example, only a rubber weather strip may be used at the lower threshold. The rubber strip may or may not include a channel for the lower door section 3. If a channel is included, the channel is preferably formed of rubber or a polymeric material so that the lower door section 3 does not bind in the channel. If a metal threshold is used, the lower door section 3 preferably is provided with substantial clearance. The lower weather strip can be utilized to seal the door against the environment while preventing the door from binding while the car twists and racks.

In still further embodiments, the high platform threshold may be supported and locked by a block assembly mounted to the carbody when in the closed position. This has the advantage of providing the stairwell platform with added support and rigidity, increasing safety.

The stairwell platform assembly may interface with the locking mechanism of the high platform threshold. In this manner, the stairwell platform may prevent the high platform threshold from being retracted when the stairwell platform is locked in the closed lower position. When the stairwell platform is raised, the stairwell platform may release the locking mechanism such that the threshold opens with the door.

Where the door is made from an upper and lower door assembly, it may be desirable to include a metal shield to protect the high platform threshold 20 from the elements when the door is closed. The metal shield may be bolted, riveted, welded, or otherwise attached to either the inner or outer portion of the door. The high platform threshold 20 may be located on the inside, outside, or within the door. The high platform threshold slides away into the door pocket when the stairwell platform is in the up position and remains extended when the stairwell platform is in the closed lower position.

The high platform threshold is particularly advantageous since it allows the door to function reliably while improving safety.

In further embodiments of the invention as shown in FIG. 4, a pillow block support 30 may be formed in any suitable configuration to support the sliding threshold 20. The pillow block support may support the threshold 20 either directly or using any suitable bearing or sliding assembly such as a ball bushing pillow block 31 (e.g., a vertical roller) and/or any suitable rail slide 32. The threshold 20 may extend outside the door as shown in FIG. 4. A solenoid 33 or other suitable interlock (e.g., a locking lever coupled to the stairwell platform) may be utilized to couple threshold 20 to door assembly 1, so that threshold 20 moves with the door when the stairwell platform is in its upper position. Details of the embodiment of FIG. 4 are shown in FIG. 5.

One embodiment of the door disclosed herein is being manufactured by Groupe Tekdata Inc., 2600 Boulevard Patt Brossard, Quebec, Canada, under a contract from the assignee of the present application.

Various modifications to the above design may be implemented by those of ordinary skill in the art. For example, it would be within the skill of the ordinary artisans to design various modifications and/or additions to the basic teachings described herein.

What is claimed is:

1. An apparatus comprising:

a rail passenger car having a door assembly formed of an upper door section and a lower door section fixed to the upper door section, the door assembly being slidable in the rail passenger car in an opening direction;

a support member, the support member being located on an interior side of the door assembly and being moveable with respect to the door assembly along a direction substantially parallel to the opening direction; and a stairwell platform hingedly attached to the rail passenger car and movable between an upper position permitting low level access via stairs and a lower position of engagement with the support member permitting high level access above the stairs, wherein the upper door section remains fixed to the lower door section when the stairwell platform is engaged with the support member, such that the door assembly slides as a single unit when the stairwell platform is in the upper position and when the stairwell platform is in the lower position.

2. An apparatus comprising:

a rail passenger car having a door assembly formed of an upper door section and a lower door section fixed to the upper door section, the door assembly being slidable in the rail passenger car in an opening direction;

a support member, and a stairwell platform hingedly attached to the rail passenger car and movable between an upper position permitting low level access via stairs and a lower position of engagement with the support member permitting high level access above the stairs, wherein the support member is disposed as an angle iron fixed to the rail passenger car, and the upper door section remains fixed to the lower door section when the stairwell platform is engaged with the support member, such that the door assembly slides as a single unit when the stairwell platform is in the upper position and when the stairwell platform is in the lower position.

3. The apparatus of claim 2, further comprising a threshold on an exterior of the rail passenger car, the threshold being positioned at the bottom of the stairs.

* * * * *